US005909711A

United States Patent [19]

Vogel et al.

[11] Patent Number: 5,909,711

[45] Date of Patent: Jun. 8, 1999

[54] BOGIE FOR A RAILWAY VEHICLE WITH ADJUSTABLE WHEEL SETS AND RAILWAY VEHICLE WITH SUCH A BOGIE

[75] Inventors: Hans Heiner Vogel, Tuttwil; Hans-Rudolf Kägi, Hermatswil, both of Switzerland

[73] Assignee: SLM Schweizerische Lokomotiv - Und Maschinenfabrik AG, Winterthur, Switzerland

[21] Appl. No.: 08/701,443

[22] Filed: Aug. 22, 1996

[30] Foreign Application Priority Data

Aug. 23, 1995 [EP] European Pat. Off. ..... 95810527

[51] Int. Cl.[6] ..... B61D 1/00

[52] U.S. Cl. ..... 105/168; 105/165; 105/167; 105/168; 105/218.2

[58] Field of Search ..... 105/165, 167, 105/168, 218.2

[56] References Cited

U.S. PATENT DOCUMENTS

| | | | |
|---|---|---|---|
| 5,211,116 | 5/1993 | Schneider | 105/168 |
| 5,213,049 | 5/1993 | Kobayashi | 105/168 |
| 5,438,933 | 8/1995 | Lipsius et al. | 105/168 |
| 5,588,367 | 12/1996 | Scheffel | 105/168 |
| 5,666,885 | 9/1997 | Wike | 105/168 |

*Primary Examiner*—S. Joseph Morano

*Attorney, Agent, or Firm*—Townsend and Townsend and Crew

[57] ABSTRACT

The bogie contains a bogie frame supported on two wheel sets with a coupling device via which the two wheel sets are coupled to one another so as to be steerable in opposite senses. The coupling device contains an additional adjustment device for the transmission of adjustment forces by which a steering movement in the same sense can be transmitted to each of the wheel sets independent of and superimposed on their oppositely directed settings. In this way an influence can be exerted on the shear movement between the wheel sets independently of the bending stiffness between the wheel sets and thus an ideal reaction of the bogie to the respectively arising free lateral acceleration can be achieved.

16 Claims, 7 Drawing Sheets

BOGIE FOR A RAILWAY VEHICLE WITH ADJUSTABLE WHEEL SETS AND RAILWAY VEHICLE WITH SUCH A BOGIE

BACKGROUND OF THE INVENTION

1. Field of the Invention

The invention relates to a bogie for a railway vehicle.

2. Description of the Prior Art

In a known bogie of the initially named type, the wheel sets are guided via two pairs of longitudinal links arranged at the two longitudinal sides of the bogie, each of which is pivotally connected to one of the axle housings. The longitudinal links are pivotally connected pair-wise in opposite senses to a coupling shaft transversely arranged on the bogie frame. The wheel sets are coupled to one another in opposite senses by the longitudinal links in the sense of passive radial self-steering (SLM-Druckschrift "Typenfamilie der Lok 2000", 1992 by Georg Siemens Verlagsbuchhandlung, in particular page 6). When travelling around a curve, the wheel sets of the known bogie are oriented approximately radially in the sense of a bending movement, i.e. pivoted through equal and opposite rotation angles about their vertical axes with respect to the position assumed during movement in a straight line. The steering angles are essentially determined by a preset stiffness to bending between the wheel sets. At the same time the oppositely directed coupling counteracts a shearing movement of the wheel sets. Using the known arrangement, a good behavior of the bogie in curves can generally be achieved which is determined, on the one hand, by the radius of curvature of the particular track section to be travelled along and, on the other hand, by the dynamic forces arising during operation and acting at the level of the tracks.

Such bogies are generally provided with damping means which act counter to the oppositely directed setting of the wheel sets in the interest of a desired operating stability so that the wheel sets are oriented at an angle of rotation deviating from the ideal radial orientation. This can lead to a deterioration of the running behavior in curves under certain operating conditions. For example, when travelling along stretches with numerous curves each having a small radius of curvature, increased forces and a corresponding wear between wheel and track must be taken into account. Under other operating conditions, in particular when large free lateral accelerations bG acting at track level arise, such as when travelling slowly along super-elevated curves (bG= approx. $-1$ m/s$^2$), or for trains with inclinable car bodies travelling rapidly around track curves (bG=approx. +2 m/s$^2$), the above-described ideal guidance of the wheel sets can either not be achieved by the known embodiment or not achieved to an adequate degree. This is due to the relatively large centrifugal forces arising under these running conditions that can lead to the wheels running up against the tracks and thus to a transmission of corresponding lateral forces through wheel flange contact, as well as to an unequal distribution of the centrifugal forces over the reaction forces between wheel and track.

SUMMARY OF THE INVENTION

The object of the invention is to provide a further developed bogie, particularly in this respect, which ensures an improved running behavior in curves when compared with previous embodiments.

In accordance with the present invention, a bogie for a railway vehicle includes a bogie frame and at least two wheel sets on which the bogie frame is supported. Each wheel set is positionable substantially radially to a respective track curve to be followed. Each wheel set includes axle housings guided movably at least in the longitudinal direction of the bogie. A coupling device couples the wheel sets to one another such that they are steerable in opposite senses. The coupling device includes an adjustment device for the transmission of adjustment forces by which an additional steering movement is transferrable to each of the wheel sets in the same sense but is superimposed on their positioning in opposite senses.

The present invention permits an intentional correction in a simple manner of the wheel set positions relative to the radial orientations of the wheel sets determined by the bending stiffness between the wheel sets. By influencing the shear motion between the wheel sets independently of this bending stiffness, in particular by reducing the stiffness to shear, a shear motion is imparted to the wheel sets which is superimposed on their respective bending motion. Accordingly, an ideal reaction of the bogie to the respectively occurring free lateral acceleration bG and an improvement of the running stability at high speeds in straight lines can be achieved.

In accordance with another embodiment of the present invention, a bogie for a railway vehicle includes a bogie frame and at least two wheel sets on which the bogie frame is supported. Each wheel set is positionable substantially radially to a respective track curve to be followed. Each wheel set includes axle housings guided movably at least in a longitudinal direction of the bogie. A coupling device couples the wheel sets to one another such that they are steerable in opposite senses. The coupling device includes an additional adjustment device that includes an active setting element for the transmission of adjustment forces by which an additional steering movement in opposite senses is transferrable to each of the wheel sets supporting their positioning in opposite senses. This allows for correction of the orientation of the wheel sets that can be achieved automatically due to the preset stiffness to bending between the wheel sets, and which is only approximately radial, by imparting to the wheel sets an additional bending movement superimposed on their respective bending movement in the sense of a further approximation to the ideal radial orientation. The lateral frictional forces between the wheel and the track are correspondingly reduced so that the wheel sets are displaced from the middle of the track channel toward the outer side of the track curve until the difference of the rolling radii between the outer wheel and the inner wheel corresponds approximately to the radius of the curve. Thereupon only slight longitudinal frictional forces arise, with the wheel sets generally being guided without wheel flange contact, so that the forces acting in the lateral and longitudinal directions between the wheel and the track, and hence the corresponding wear, are minimized. Thus, an ideal reaction of the bogie corresponding to the curve radius of the respective track curve to be traversed is permitted.

DETAILED DESCRIPTION OF THE PREFERRED EXEMPLARY EMBODIMENTS

Figure 1:
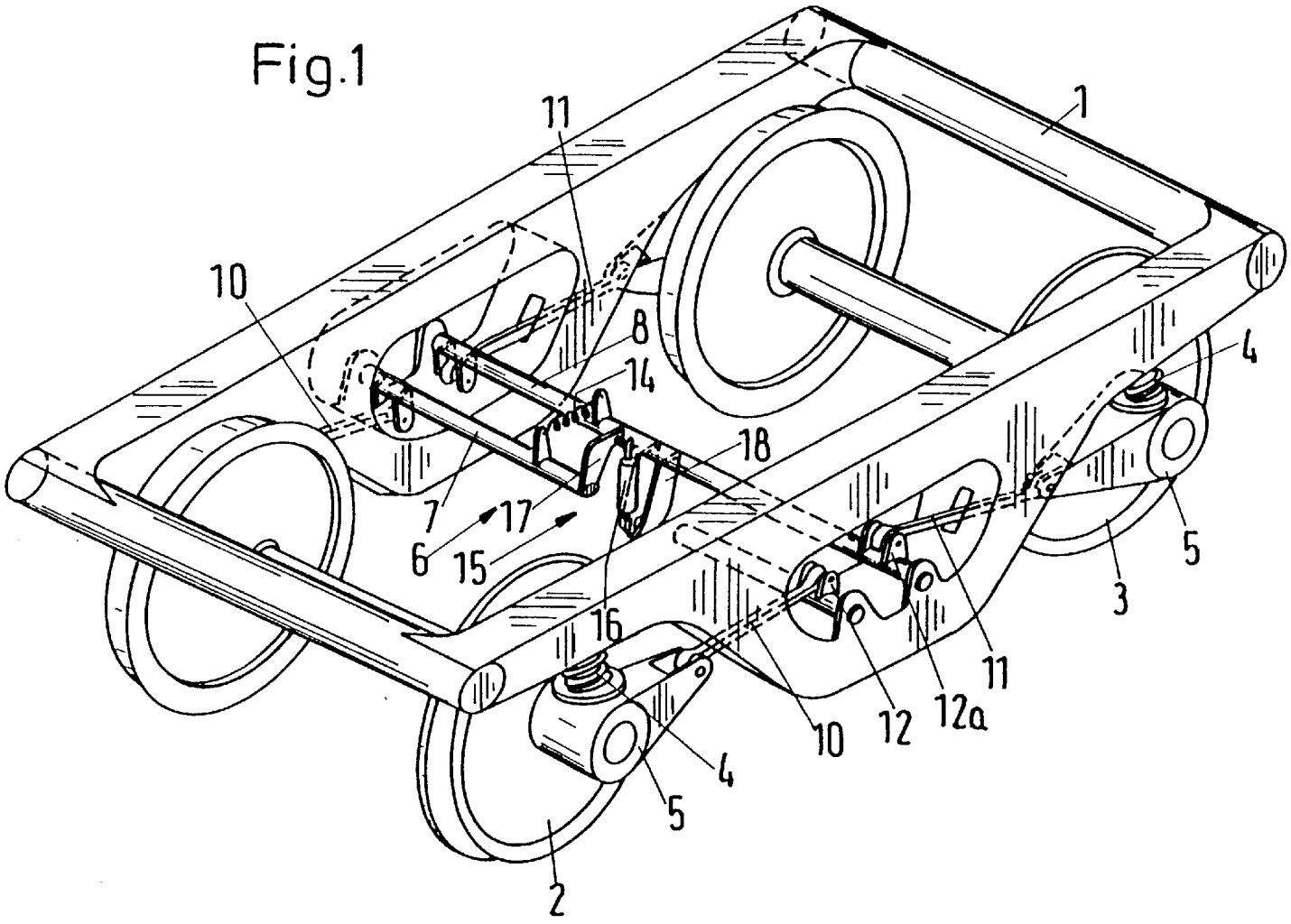
FIG. 1 is a simplified perspective view of a bogie designed in accordance with the present invention for a railway vehicle with a mechanical coupling device.

The bogie of FIG. 1 comprises a bogie frame and two wheel sets 2 and 3 on which the bogie frame 1 is supported via deflectable springs 4 and an axle housing 5 guided movably in the longitudinal bogie direction. The wheel sets 2 and 3 are connected to one another via a coupling device 6 so that they are pivotable in opposite senses about respective vertical axes at the center of the wheel set in the sense of a passive radial self-steering movement. The coupling device 6 contains two coupling shafts 7 and 8 and two pairs of longitudinal links 10 and 11. The two pairs of longitudinal links are pivotally connected pair-wise in opposite senses to one each of the coupling shafts 7 or 8 via one-armed steering levers 12 or 12*a,* respectively, connected thereto, and are pivotally connected at the other ends to the axle housings 5 of the associated wheel sets 2 and 3, respectively. The axle housings 5 are horizontally movably held via guide means which are not shown. The wheel sets 2 and 3 are guided via the coupling device 6 in such a manner that while travelling through a track curve, e.g. a right-hand curve in the direction of travel in accordance with arrow 13 in FIG. 1*a,* the leading wheel set 3 is turned clockwise through an angle βk to a steering position 3' shown in chain dotted lines, and the trailing wheel set 2 is turned counterclockwise through the same angle βk to a steering position 2', with the coupling shafts 7 and 8 each being adjusted in opposite senses of rotation. These adjustment movements can be restricted by a spring arrangement 14 connecting the coupling shafts 7 and 8, by means of which a preset bending stiffness of the connection between the wheel sets 2 and 3 can be achieved corresponding to its spring characteristic.

Figure 1A:
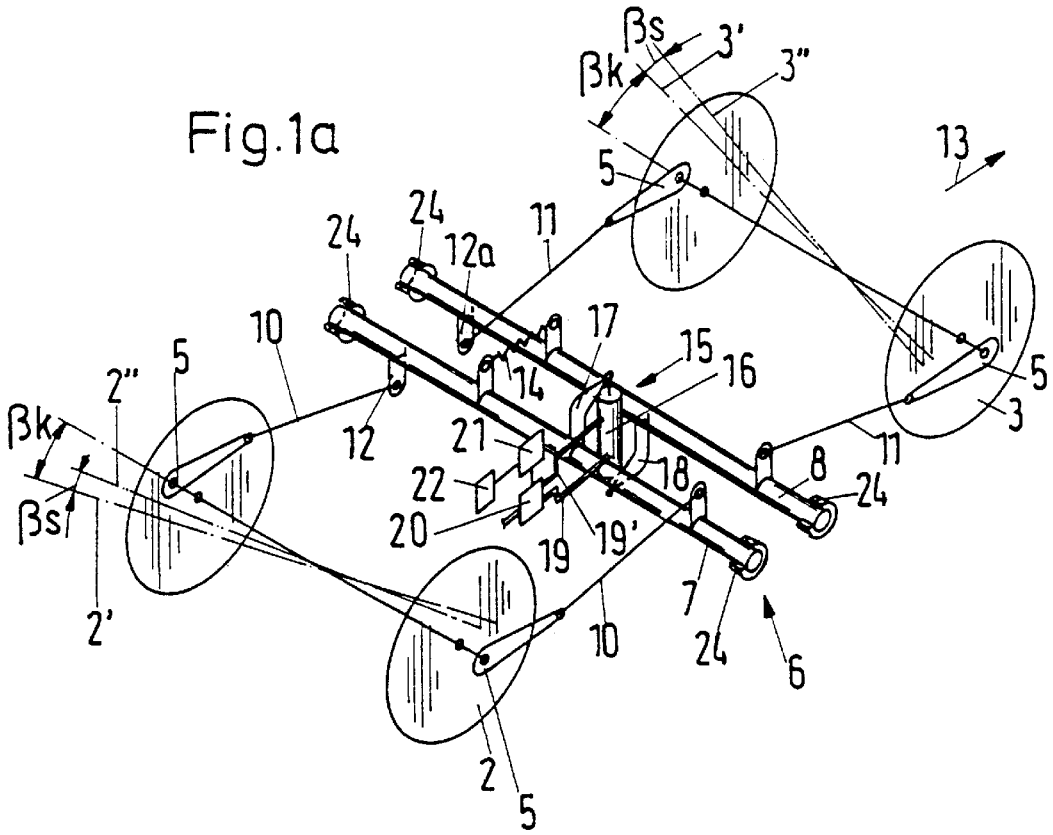
FIG. 1*a* is a skeletal representation of the bogie of FIG. 1, FIGS. 2 to 8 are skeletal representations of further bogies with mechanical coupling devices, each in accordance with a different embodiment of the present invention.

The coupling device 6 further contains an additional adjustment device 15 containing a setting means in the form of a doubly acting piston/cylinder unit 16 which is arranged between the coupling shafts 7 and 8 and is connected to pivot parts 17 or 18, respectively, mounted on these shafts 7 and 8 in opposite senses. The cylinder spaces of the piston/cylinder unit 16 can, as indicated in FIG. 1*a,* be connected via lines 19, 19' and a changeover valve 20 to a non-illustrated source of a pressure medium, for example compressed air. The valve 20 can be adjusted via a control device 21 between a blocking position which blocks the supply of pressure medium and two throughflow positions, which can selectively admit the supply of pressure medium to one of the cylinder spaces, with respective oppositely directed adjustment forces being transferred to the two coupling shafts 7 and 8.

The control of the supply of pressure medium to the one or other cylinder space can in each case, as indicated in FIG. 1*a*, be controlled in response to control signals from a lateral acceleration sensor 22 measuring the uncompensated lateral acceleration bG of the vehicle, or from a different corresponding signal generator, e.g. from a gyroscope or an angle sensor. For states of travel with small lateral acceleration bG, for instance when travelling straight ahead and when travelling through track curves with large radii, the supply of pressure medium to the piston/cylinder unit 16 can be blocked so that the wheel sets 2 and 3 are guided via the coupling shafts 7, 8 and the spring arrangement 14 parallel to one another, or each steerably guided through the angle βk in opposite senses. When a predetermined value of the free lateral acceleration bG is exceeded, shown in the case of a right-hand curve, the valve 20 is switched over in response to the corresponding signal from the lateral acceleration sensor 22 and pressure medium is fed into the upper cylinder space of the piston/cylinder unit 16. Accordingly, the swivel parts 17 and 18 are forced apart and the coupling shafts 7 and 8 are pivoted in the same sense each about its axis. The wheel sets 2 and 3 are thereby each pivoted clockwise through an equal turning angle βs about their vertical axes into an angular position 2", or 3", respectively, shown in chain dotted lines. A shear motion is thus imparted to the wheel sets 2 and 3 superimposed on their respective bending movements, whereby the angle of turning βk of the leading wheel set is increased by the angle βs and the angle of turning βk of the following wheel set is decreased by the same angle βs.

Figure 2:
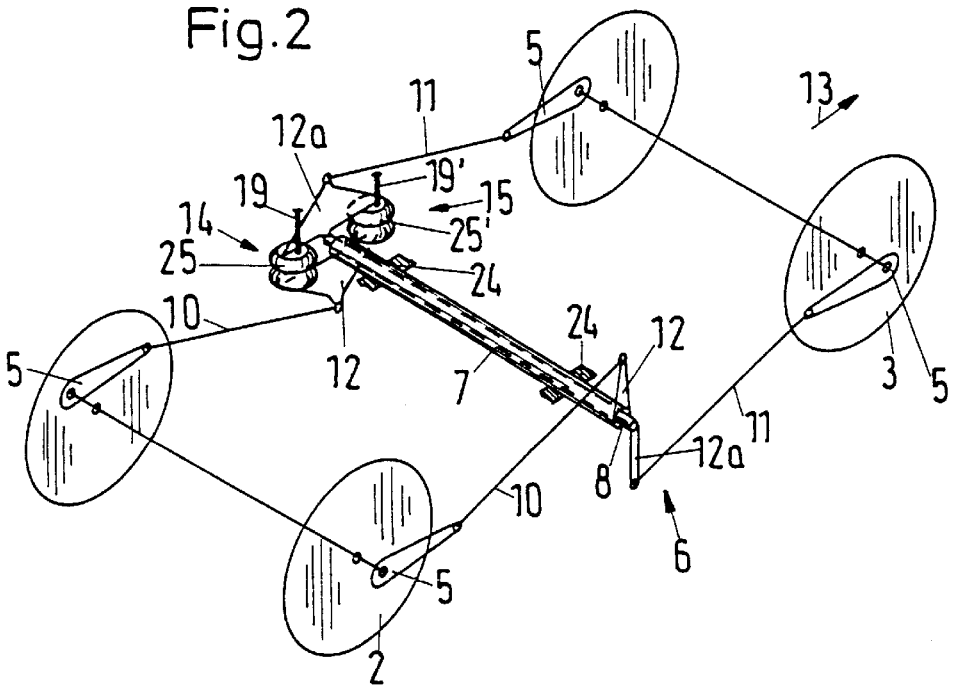

In the exemplary embodiments, parts corresponding to one another are designated with the same reference numerals. In the embodiment of FIG. 2, the coupling shaft 7 is journalled in the coupling shaft 8, which is executed as a hollow shaft, and which is itself rotatably journalled in bearings 24 arranged in the bogie 1. At one longitudinal side of the bogie the steering levers 12 and 12*a* are each executed with two lateral support arms by means of which the coupling shafts 7 and 8 are braced against one another via the adjustment device 15. The adjustment device 15 contains two support elements in the form of spring bellows 25, 25' each adjustable to a predetermined spring force, which are each arranged between the oppositely disposed support arms of the guide levers 12 and 12*a* and by which the bending stiffness between the wheel sets 2 and 3 is determined. The spring bellows 25, 25' are connected to a source of compressed air via the lines 19, 19' and a changeover valve 20 not shown. When travelling around a right-hand curve in accordance with arrow 13 the wheel sets 2 and 3, as previously described, are turned outwards in opposite senses with the coupling shafts 7 and 8 each being displaced in the same rotational sense, clockwise for the assumed direction of travel. When the predetermined value of the free lateral acceleration bG is exceeded, compressed air is conveyed to the spring bellows 25, with the coupling shafts 7 and 8 being adjusted, each in an opposite rotating sense, the coupling shaft 8 being adjusted clockwise and the coupling shaft 7 counterclockwise for the assumed direction of travel. Accordingly, the wheel sets 2 and 3 are each swivelled additionally through a corresponding, equal turning angle βs about their vertical axes, so that a shear movement is imparted to them superimposed on their respective bending movements.

Figure 3:
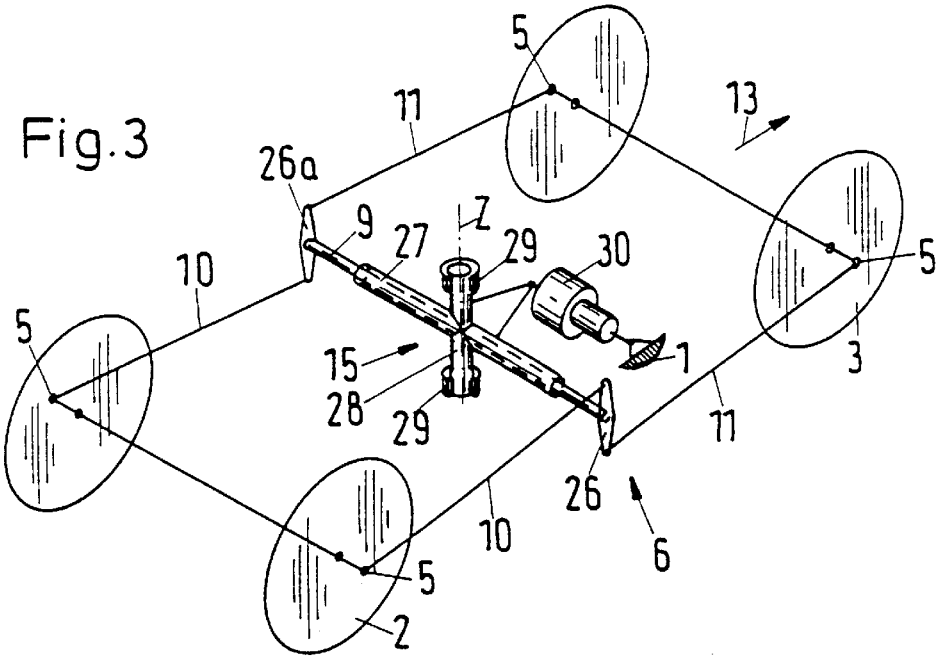

In the bogie of FIG. 3, the coupling device 6 contains a single coupling shaft 9 via which the wheel sets 2 and 3 are coupled together so that they can turn in opposite senses. The coupling shaft 9 is provided at its ends with two-armed steering levers 26, 26*a* to which the longitudinal links 10 and 11 are pivotally connected in opposite senses. The coupling shaft 9 is journalled in a bearing arrangement swivellable about a vertical axis Z. The bearing arrangement forms a part of the additional adjustment device 15 for the wheel sets 2 and 3. The bearing arrangement contains a carrier tube 27 in which the coupling shaft 9 is journalled and which is pivotally mounted on the bogie frame about the vertical axis Z via spindle 28 arranged transverse to its longitudinal axis in bearings 29 arranged one above the other. In this embodiment the adjustment device 15 contains a damping device 30 pivotally connected to the bogie 1 and to a bracket of the carrier tube 27 in the form of a piston/cylinder aggregate via which the coupling shaft 9 is adjustably held about the vertical axis Z in each case corresponding to an additional turning of the wheel sets 2 and 3 in the same sense. When travelling around a right-hand curve in accordance with arrow 13, the wheel sets 2 and 3 are turned in opposite senses in the sense of a bending movement, with the coupling shaft 9 being pivoted about its axis of rotation. For increased values of the free lateral acceleration bG, the carrier tube 27 is swivelled about the vertical axis Z via the damping device 30 with an additional turning movement in the same sense being imparted to the wheel sets 2 and 3 superimposed on their bending movement.

Figure 4:
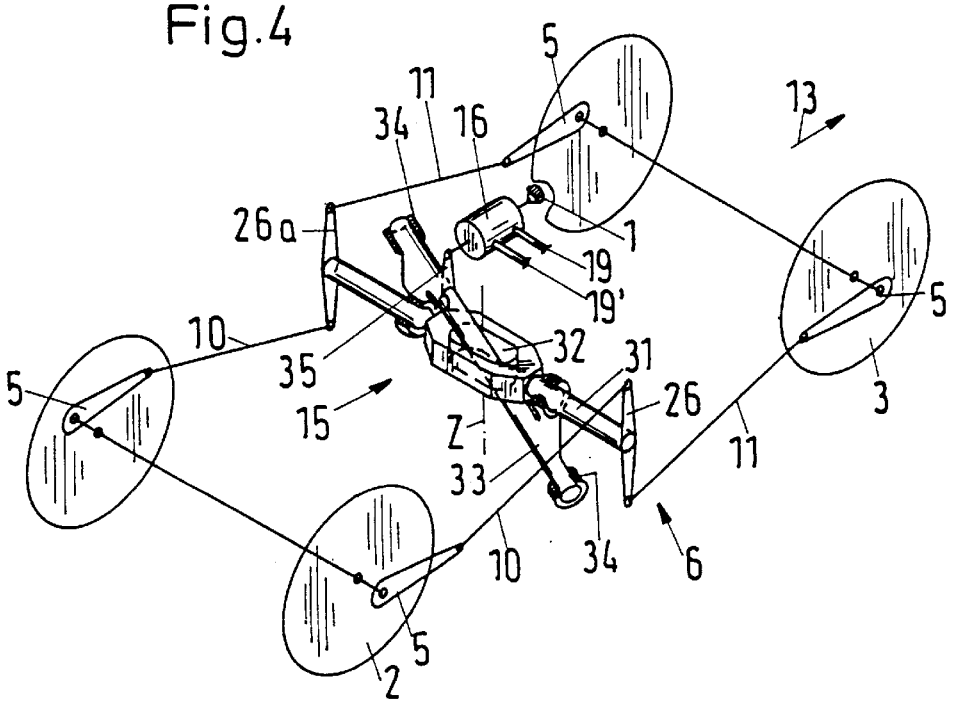

The coupling device 6 of FIG. 4 likewise contains a coupling shaft 31 journalled in a movable bearing arrangement, with the coupling shaft 31 being executed with an opening 32 passing through it transversely to its axis of rotation in a mid-section of its length. The bearing arrangement is formed at a guide shaft 33 passing obliquely through the passage opening 32 and journalled at the bogie frame 1 in bearings 34 arranged above and below the coupling shaft 31, with the said shaft being adjustably held by a piston/cylinder unit 16. The through guided shaft 33 can be adjusted about its inclined axis of rotation via the piston/cylinder unit 16, which is pivotally connected to the bogie frame 1 and to the steering lever 35 connected to the guide shaft 33, and thus the coupling shaft 31 can be adjusted in a sort of tumbling motion essentially about the vertical axis Z corresponding to an additional steering movement of the wheel sets 2 and 3 in the same sense.

Figure 5:
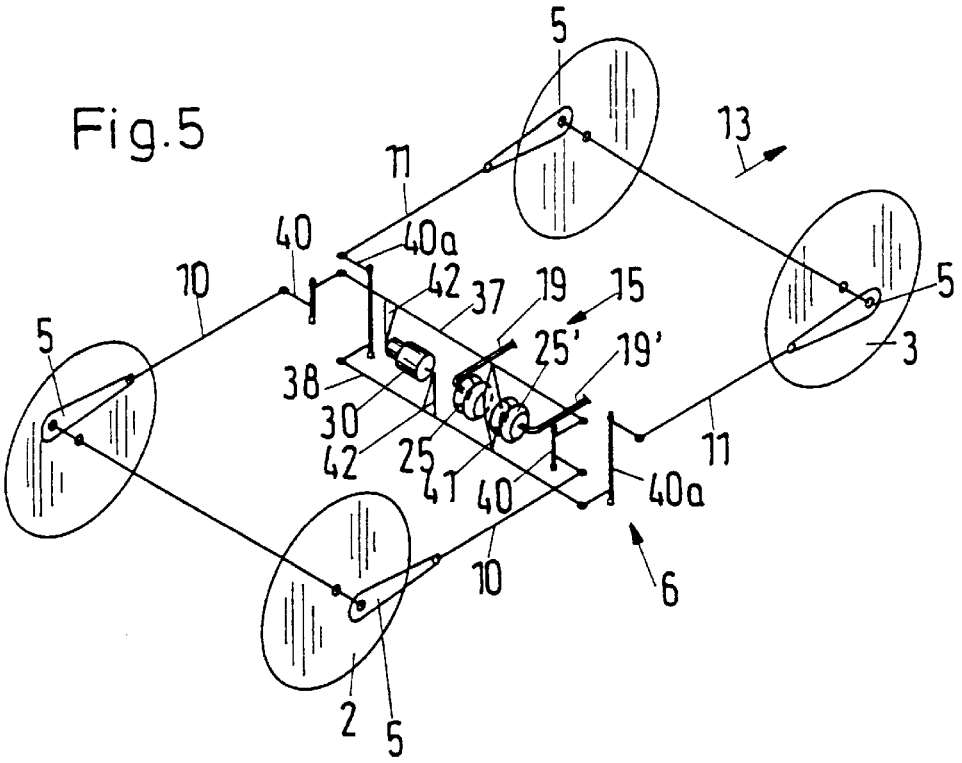

The coupling device 6 of FIG. 5 contains two coupling rods 37 and 38 placed transversely and each associated with one of the wheel sets 2 and 3. Each of the coupling rods is movably coupled via two angled levers 40 or 40*a,* respectively, pivotally connected to the bogie frame 1 in opposite senses to the associated wheel sets 2 or 3, respectively, corresponding to an adjustment of the wheel sets 2 and 3 in opposite senses. The coupling rods 37 and 38 are connected to one another via a balancer 41 pivotally connected to them which is held between two spring bellows 25 and 25'. The spring bellows 25 and 25' are arranged between two supporting parts mounted on the bogie frame 1, which are not shown, and are braced against them. The coupling rods 37 and 38 are further coupled to one another via a damping device 30 which is arranged between two holders 42 each mounted on one of the coupling rods 37 and 38.

During an outward turning of the wheel sets 2 and 3 in opposite senses, the coupling rods 37, 38 are displaced in the transverse direction in the same sense together with the balancer. When a predetermined value of the free lateral acceleration bG is exceeded—in the assumed right-hand curve in accordance with arrow 13—compressed air is supplied to the spring bellows 25, with the balancer being held in the middle and being pivotable about the spring bellows 25, so that the coupling rods 37, 38 are moved in opposite senses in the transverse direction and thus an additional shear movement is imparted to the wheel sets 2 and 3 superimposed on their respective bending movements.

Figure 6:
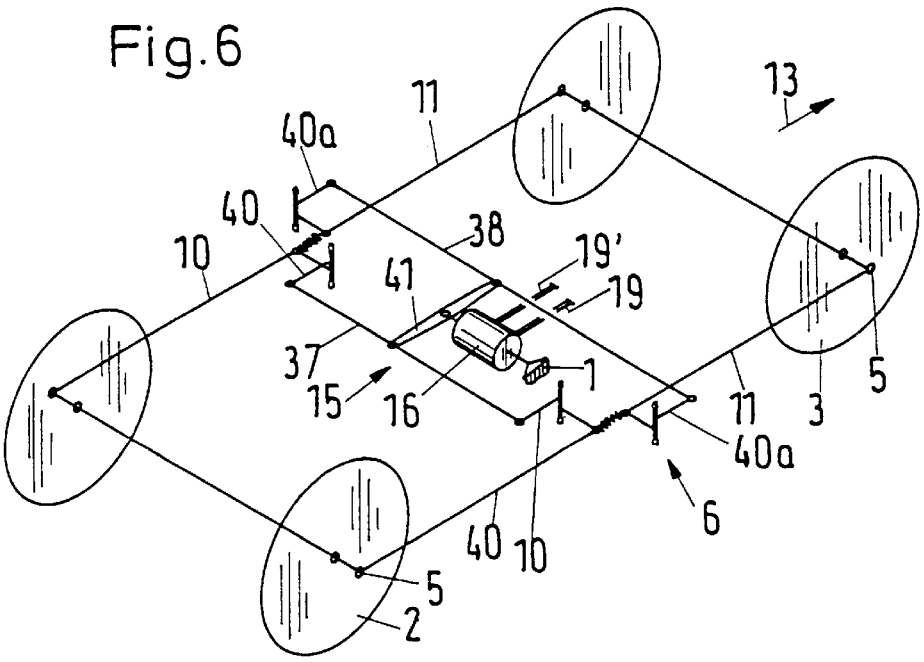

In the bogie of FIG. 6, the coupling rods 37 and 38 are guided movably in the transverse direction via angled levers 40 and 40*a,* respectively, pivotally connected in opposite senses to the bogie frame 1, and are coupled together via the balancer 41 pivotally connected to them, which is adjustably held in the lateral direction at the middle via the piston/cylinder unit 16 which is pivotally connected to the bogie frame 1. When the wheel sets 2 and 3 are turned in opposite senses, the coupling rods 37 and 38 are moved in the transverse direction in the same sense with the balancer 41 being pivoted about its central pivot position. When the predetermined value of the free lateral acceleration bG is exceeded in the assumed state of travel, the balancer 41 in FIG. 6 is adjusted to the left by the supply of compressed air into the corresponding cylinder space, e.g. via the line 19, so that the coupling rods 37 and 38 are moved in the transverse direction in the same sense and the corresponding shear movement is imparted to the wheel sets superimposed on their bending movements.

Figure 7:
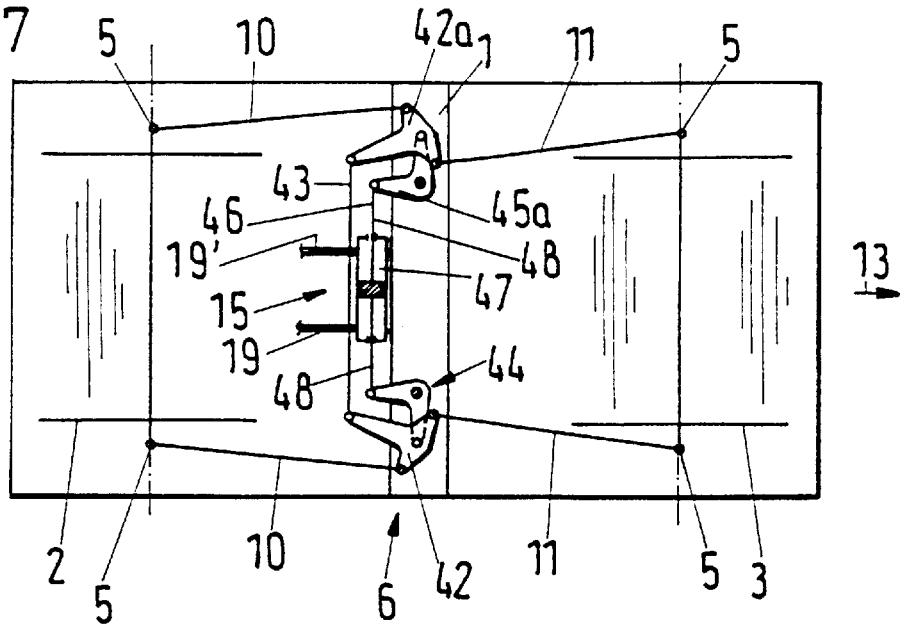

In the bogie of FIG. 7, the coupling device 15 contains two three-armed pivot levers 42 and 42*a* which are coupled to one another via a coupling rod 43 and via which the wheel sets 2 and 3 are steerably coupled in opposite senses. The pivot levers 42 and 42*a* are pivotally and movably connected in the longitudinal direction of the bogie at a holder 44 journalled at the bogie frame 1. The holder 44 forms a part of the adjustment device. The holder 44 comprises two angled levers 45 and 45*a* hinged at the bogie frame 1, which angled levers 45 and 45*a* are coupled to one another in the same sense in the transverse direction via a second coupling rod 46, with the pivot levers 42 and 42*a* each being pivotally connected at a free arm of the angled levers 45 and 45*a,* respectively. The second coupling rod 46 is shown executed in the form of a through-going piston rod of a piston/cylinder device 47 whose cylinder is mounted on the bogie frame 1. To compensate for the relative movements of the coupling rod 46 resulting from the pivotal movements of the angled levers 45, 45*a,* the latter can be provided with joints 48. In this embodiment—in the assumed state of travel with increased free lateral acceleration bG—the angled levers 45 and 45*a* can each be pivoted clockwise by a supply of compressed air into the corresponding cylinder space, e.g. via the line 19, and thus the pivot points of the pivot levers 42, 42*a* can be moved in the longitudinal direction toward the wheel sets 2 and 3, respectively so that the corresponding shear movement is imparted to the wheel sets 2 and 3 superimposed on their bending movements.

Figure 8:
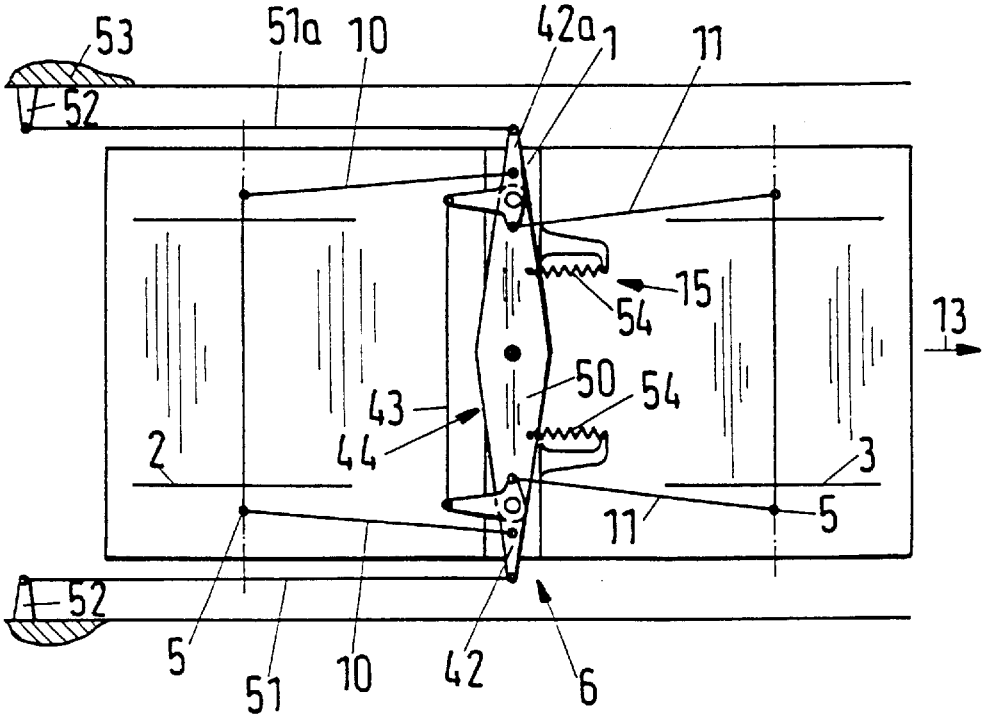

In the bogie in FIG. 8, the holder 44 contains a transverse carrier 50 pivotally connected to the bogie frame 1 and swivellable about the vertical axis Z, with the pivot levers 42, 42*a* being pivotally connected to the two ends of the transverse carrier 50. In this embodiment, the pivot levers 42, 42*a* are each coupled via a longitudinal link 51 or 51*a*, respectively, to a coupling part 52 or 52*a*, respectively, of the vehicle body 53 supported on the bogie frame 1. The transverse carrier 50 is supported on the bogie frame 1 via two spring elements 54, each adjustable to a predetermined spring force. In this embodiment, the radial setting of the wheel sets 2 and 3 is controlled corresponding to the respective turning of the bogie frame 1 with respect to the vehicle body 53, with the transverse carrier 50 being held in the illustrated middle position by the spring elements 54 up to a predetermined value of the free lateral acceleration bG. The wheel sets 2 and 3 are turned in opposite senses via the pivot levers 42, 42*a*. For increased values of the free lateral acceleration bG, or on exceeding the predetermined spring force of the spring element 54, the transverse carrier 50 is swivelled about the vertical axis Z and thus an additional shear movement is imparted to the wheel sets 2 and 3 superimposed on their bending movements.

Figure 9:
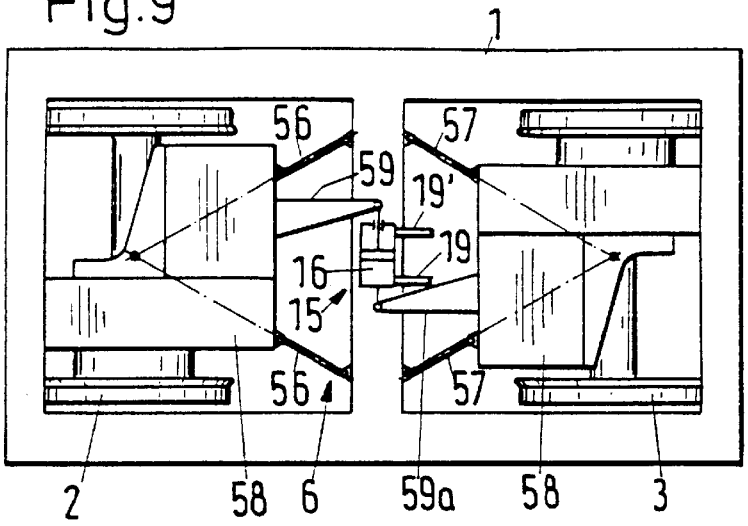
FIG. 9 is a plan view of a bogie with a mechanical coupling device in accordance with another embodiment of the present invention.

For the bogie of FIG. 9, the coupling device 6 contains two pairs of longitudinal links 56 and 57 pivotally connected to the bogie frame 1 and each arranged convergent to one of the wheel sets 2 or 3, respectively, in the longitudinal bogie direction. When seen in plan view, the imagined continuations of the longitudinal axes of the longitudinal links each intersect within the ground plan area of the wheel sets 2 or 3, respectively, shown in the illustration to be at the wheel set axis. The longitudinal links 56 and 57 are each pivotally connected at the wheel set side to a drive unit 58 supported on the wheel set 2 or 3, respectively, and consisting of a motor with a gear box. By means of this link arrangement, an approximately radial orientation of the wheel sets 2 and 3 is achieved in each case when travelling around a curve. In this embodiment, an active setting means arranged transversely between the wheel sets 2 and 3 is provided as an additional adjustment device 6 and is illustrated as a piston/cylinder unit 16, the piston rod of which is pivotally connected to a supporting part 59 projecting in a longitudinal direction from the wheel set 2 and the cylinder of which is pivotally connected to a corresponding supporting part 59*a* projecting from the wheel set 3. When travelling around a curve with low free lateral acceleration bG, the wheel sets 2 and 3, which are relatively rigidly coupled via the piston/cylinder unit 16, are deflected in opposite senses, with the piston essentially retaining its position within the cylinder. With increased lateral acceleration bG, the piston is displaced by a supply of compressed air, e.g. via the line 19, and thus an additional steering movement in the same sense is transmitted to the two wheel sets 2 and 3.

Figure 10:
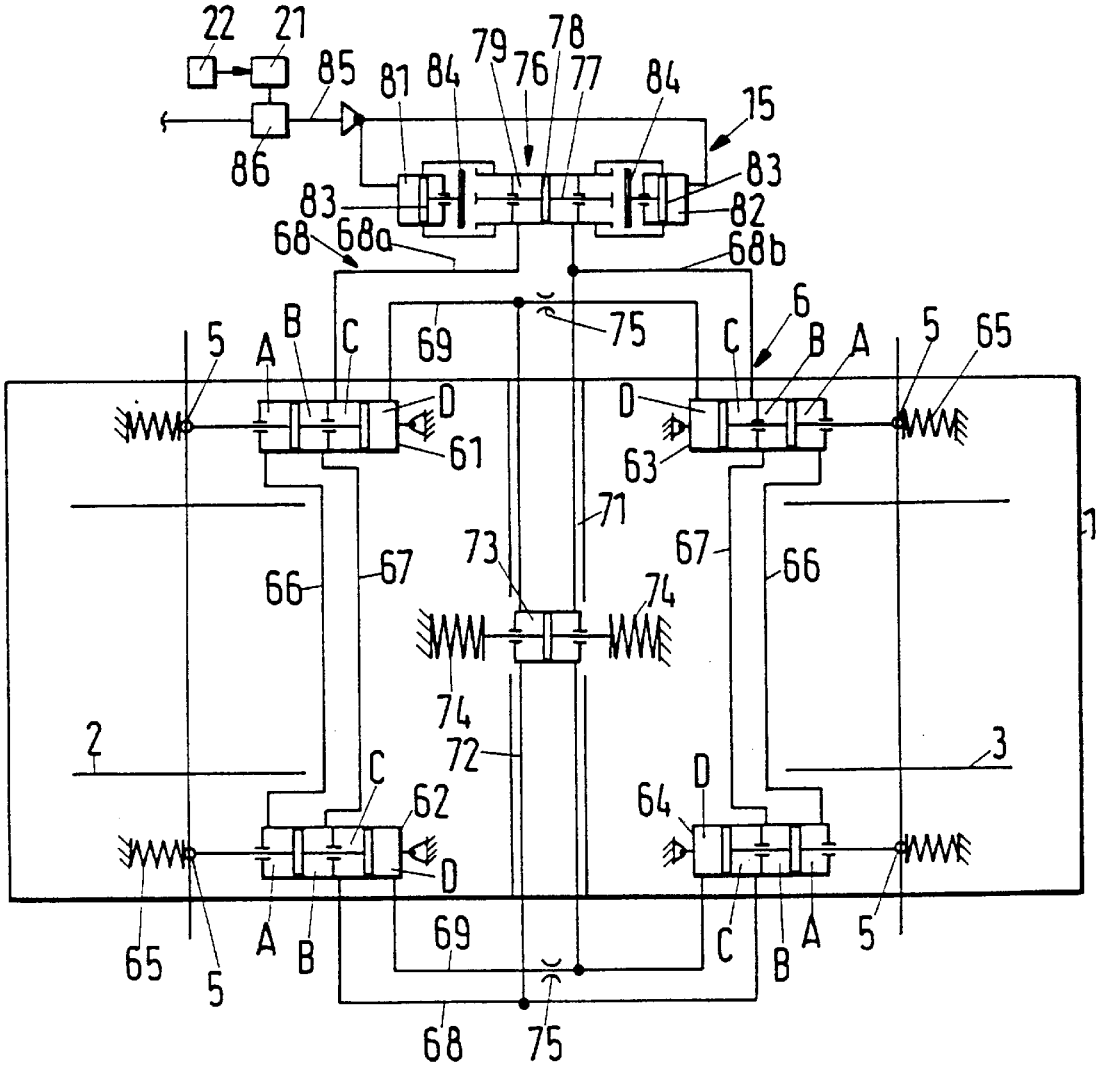
FIG. 10 is a skeletal view of a bogie in accordance with a further embodiment of the present invention, with a fluidic coupling device.

In the bogie of FIG. 10, a hydraulic linkage is provided as the coupling device and contains two pairs of doubly acting piston/cylinder devices each associated with one of the wheel sets 2 and 3 and shown as doubly acting tandem aggregates 61, 62 and 63, 64. Each of these has two pistons, which each bound two cylinder spaces A and B or C and D, respectively. The aggregates 61, 62 and 63, 64 are each pivotally connected via their cylinders to the bogie frame 1 and via their piston rods in the opposite sense to the axle housings 5, each of which is connected to the bogie frame 1 in the longitudinal direction via a spring arrangement 65. The similarly oriented cylinder spaces A and B of the aggregates 61 and 62 or 63 and 64, respectively, each associated with the same wheel set 2 or 3, respectively, are—in accordance with an oppositely directed steering of the wheel sets 2 and 3—connected to each other via a line 66 or 67, respectively. The cylinder spaces C and D of the aggregates 61 and 62 associated with the wheel set 2 are each coupled via lines 68 or 69, respectively, to the oppositely directed cylinder space C or D, respectively, of the aggregate 63 or 64, respectively, associated with the wheel set 3 on the same longitudinal side of the bogie. The lines 68 and 69 on the one longitudinal side are each further coupled to the line 69 or 68, respectively, on the other longitudinal side via a connection line 71 or 72, respectively. The connection lines 71 and 72 are each connected to a cylinder space of a doubly acting piston/cylinder aggregate 73 whose piston is held via a through-going piston rod between two spring members 74 supported at the bogie frame 1. Furthermore, each of the lines 69 can contain a throttle member 76 for damping of the shearing movements of the wheel sets 2 and 3. The additional adjustment device 15 contains a further doubly acting piston/cylinder aggregate 76 with a piston 78 arranged on a through-going piston rod 77 and a cylinder 79 whose cylinder spaces are each connected to a section 68*a* or 68*b*, respectively, of the line 68. The adjustment device 6 further contains two control cylinders 81 and 82 associated with the two ends of the piston rod 77 and having control pistons 83 which are each connected to an abutment part 84 for the ends of the piston rod 77. The control cylinders 81 and 82 are connected to a source of a pressure medium not shown via a line 85 and a control valve 86. By means of the control valve 86, the abutment parts 84 are each adjustable via the control pistons 83 between the illustrated position, which permits displacements of the piston 78, and an abutment position contacting the cylinder 79 for the piston rods 77.

When travelling around a curve at low lateral acceleration bG, the piston 78 is blocked in its illustrated position by the abutment parts 84, and the wheel sets 2 and 3 coupled via the hydraulic linkage are turned in the opposite sense, with the stiffness to bending between the wheel sets 2 and 3 being determined by the spring elements 74 of the piston/cylinder aggregate 73. For increased lateral acceleration bG, the pressure in the cylinder spaces of the control cylinders 81 and 82 is relieved via the control valve 86 so that the piston 78 can be displaced, whereby a steering movement in the same sense can be imparted to the wheel sets 2 and 3 coupled via the lines 68, 69 in the sense of a shearing movement superimposed on their bending movement.

Figure 11:
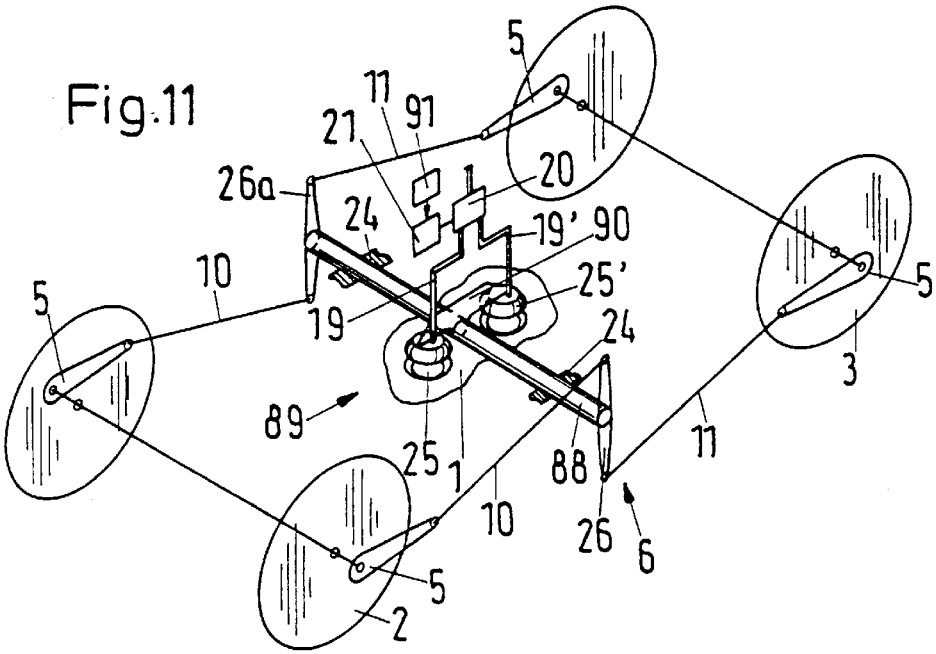
FIG. 11 is a skeletal view of a bogie in accordance with a further alternative embodiment.

In the bogie of FIG. 11, the coupling device 6 contains a single coupling shaft 88 and an additional adjustment device 89 for transmitting adjustment forces, which brings about an additional turning of the wheel sets 2 and 3 in opposite senses, respectively, assisting the steering movement thereof in opposite senses. The adjustment device 89 contains a two-armed lever 90 mounted on the coupling shaft 88 and an active setting element illustrated in the form of two spring bellows 25 and 25' arranged on both sides of the coupling shaft 88 and supported on the bogie frame 1. The spring bellows 25, 25' are each connected to a source of a pressure medium via a line 19 or 19', respectively, and the changeover valve 20. The valve 20 can be adjusted via the control device 21 between a blocking position blocking the supply of pressure medium and two throughflow positions, which can be chosen to admit the supply of pressure medium to one of the spring bellows 25 or 25', respectively, with the corresponding adjusting forces directed opposite to one another being transmitted to the coupling shaft 88. The control of the supply of pressure means can be controlled in response to control signals of a signal generator 91 which reacts to the radius of curvature of the respective track curve which is to be driven along, e.g. of a signal generator which reacts to the angle of turning of the bogie frame 1 with respect to the vehicle body. In this embodiment, an additional bending movement can be respectively imparted to the wheel sets 2 and 3 superimposed on their actual bending movement, e.g. when travelling around a sharp track curve.

Figure 12:
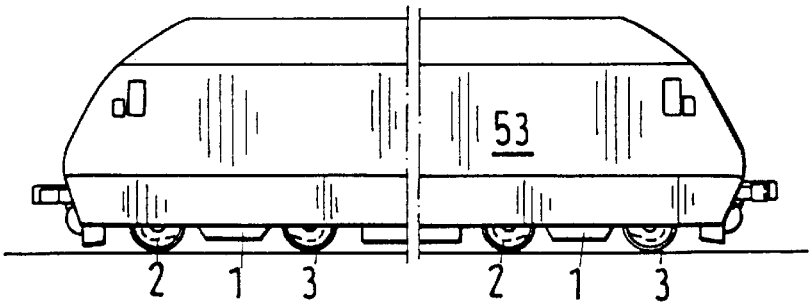
FIG. 12 is a side view of a railway vehicle with bogies in accordance with the invention.

The railway vehicle of FIG. 12 contains two bogies executed in accordance with the invention and a vehicle body 53 supported on the two bogie frames 1.

In summary the invention can be described as follows:

The bogie contains a bogie frame 1 supported on two wheel sets 2 and 3 with a coupling device 6 via which the two wheel sets 2 and 3 are coupled to one another so as to be steerable in opposite senses. The coupling device 6 contains an additional adjustment device 15 for the transmission of adjustment forces by which a steering movement in the same sense can be transmitted to each of the wheel sets 2 and 3 independent of and superimposed on their oppositely directed settings. In this way an influence can be exerted on the shear movement between the wheel sets 2 and 3 independently of the bending stiffness between the wheel sets 2 and 3 and thus an ideal reaction of the bogie to the respectively arising free lateral acceleration can be achieved.

What is claimed is:

1. A bogie for a railway vehicle, the bogie comprising:

a. a bogie frame;

b. at least two wheel sets on which the bogie frame is supported, each wheel set being positionable substantially radially to a respective track curve to be followed, each wheel set comprising axle housings guided movably at least in the longitudinal direction of the bogie; and c. a coupling device via which the wheel sets are coupled to one another such that they are steerable in opposite senses, the coupling device including an adjustment device for the transmission of adjustment forces to the coupling device, the adjustment device and the coupling device being coupled to one another via a support connection by which the coupling device is adjustably held according to the respective positioning of the wheel sets in opposite senses, and via which, in a case of the transmission of the respective adjustment force, a corresponding additional steering movement is transferable to each of the wheels sets in the same sense but is superimposed on their positioning in opposite senses.

2. A bogie in accordance with claim 1 wherein the coupling device includes a rotatably mounted coupling shaft located transversely in the bogie frame and two pairs of longitudinal links pivotally connected pair-wise to the shaft in opposite senses and pivotally connected to the two outer wheel sets, wherein the coupling shaft is coupled to the additional adjustment device so as to be adjustable about a vertical axis of rotation corresponding to the additional steering of the wheel sets.

3. A bogie in accordance with claim 2 wherein at least one support element positionable in at least one position is provided as a setting means.

4. A bogie in accordance with claim 3 wherein a piston/cylinder device connectable to a source of a pressure medium is provided as the support element.

5. A bogie in accordance with claim 1 wherein the coupling device includes a coupling shaft that is mounted in a movable bearing arrangement that is mounted on the bogie frame such that it may swivel about a vertical axis; and wherein the additional adjustment device contains at least one setting means via which the bearing arrangement is adjustably held about this vertical axis.

6. A bogie in accordance with claim 5 wherein a damping device is provided as the setting means.

7. A bogie in accordance with claim 1 wherein the coupling device contains two transversely disposed coupling shafts each associated with a respective one of the wheel sets and pivotally mounted at the bogie frame, with each coupling shaft being movably coupled to its respective wheel set via two longitudinal links in accordance with the mutually opposite steering sense of the wheel sets and being braced against each other via a flexible support connection which counteracts this steering in the opposite sense; and wherein the additional adjustment device contains at least one setting means coupled to the two coupling shafts via which the coupling shafts are adjustably held relative to one another in accordance with the steering of the two wheel sets in the same sense.

8. A bogie in accordance with claim 1 wherein the coupling device includes two transversely disposed coupling rods each associated with a respective one of the wheel sets, each of the coupling rods being movably coupled to its respective wheel set in accordance with the steering of the wheel sets in opposite senses via two angled levers that are movably hinged to the bogie frame in the transverse direction and two longitudinal links pivotally connected to the angled levers; and wherein the additional adjustment device contains at least one setting means coupled to the two coupling rods via which the coupling rods are adjustably held in the transverse direction in accordance with the steering of the two wheel sets in the same sense.

9. A bogie in accordance with claim 8 wherein the setting means is placed between the bogie frame and a balancer pivotally coupled to the two coupling rods, the balancer being adjustably held in the transverse direction via the setting means.

10. A bogie in accordance with claim 1 wherein the coupling device contains two three-armed pivot levers that are movably coupled to one another via a transversely disposed coupling rod and each movably coupled to the two wheel sets in accordance with the steering of the two wheel sets in the opposite sense via two longitudinal links pivotally connected to the pivot levers; wherein the additional adjustment device is a holder, journalled at the bogie frame, to which the two pivot levers are each pivotally connected and movable in the longitudinal direction of the bogie; and wherein at least one setting element is provided via which the two pivot levers are adjustably guided in the longitudinal direction of the bogie in accordance with the steering of the two wheel sets in the same sense.

11. A bogie in accordance with claim 10 wherein the holder includes a transverse beam pivotally hinged to the bogie frame about a vertical axis, with a respective one of the three-armed pivot levers being pivotally connected to each of the two ends of the transverse beam; wherein the pivot levers are each coupled via a respective longitudinal link to a vehicle body supported on the bogie frame; and wherein the setting means is placed between the bogie frame and the transverse beam.

12. A bogie in accordance with claim 1 wherein the coupling device contains two pairs of longitudinal links pivotally connected to the bogie frame, convergingly arranged pair-wise in the longitudinal direction of the bogie towards and pivotally coupled to one of the wheel sets, with the wheel sets being guided for steering in the opposite sense by the longitudinal links; and wherein at least one active setting means transversely disposed between the wheel sets is provided as the additional adjustment device, said setting means being pivotally connected to two supporting parts each projecting from one of the wheel sets in the longitudinal direction via which the wheel sets are additionally held so as to be steerable in the same sense.

13. A bogie in accordance with claim 1 wherein the coupling device contains a hydraulic linkage, which contains two pairs of associated doubly acting piston/cylinder aggregates each connected to one of the wheel sets via which the wheel sets are coupled for steering in opposite senses; and wherein an additional doubly acting piston/cylinder aggregate connectable to a source of pressure medium is provided as an additional adjustment device, with its cylinder spaces being each connected to the cylinder spaces of the piston/cylinder aggregates that are connected to the wheel sets to bring about steering of the wheel sets in the same direction.

14. A bogie in accordance with claim 1 wherein a spring arrangement is provided as a support element and contains two spring elements that act against one another and are each adjustable to a predefined spring force.

15. A bogie in accordance with claim 14 wherein the spring elements are each formed by a spring bellows connectable to a source of a pressure medium.

16. A bogie for a railway vehicle, the bogie comprising:

a. a bogie frame;

b. at least two wheel sets on which the bogie frame is supported, each wheel set being positionable substantially radially to a respective track curve to be followed, each wheel set comprising axle housings guided movably at least in the longitudinal direction of the bogie; and c. a coupling device via which the wheel sets are coupled to one another such that they are steerable in opposite senses, the coupling device comprising:

an adjustment device for the transmission of adjustment forces by which an additional steering movement is transferable to each of the wheel sets in the same sense but is superimposed on their positioning in opposite senses; and two transversely disposed coupling shafts each associated with a respective one of the wheel sets and pivotally mounted at the bogie frame, each coupling shaft being movably coupled to its respective wheel set via two longitudinal links in accordance with the mutually opposite steering sense of the wheel sets and being braced against each other via a flexible support connection that counteracts this steering in the opposite sense;

wherein the adjustment device contains at least one setting means coupled to the two coupling shafts via which the coupling shafts are adjustably held relative to one another in accordance with the steering of the two wheel sets in the same sense.

* * * * *